US007451825B2

(12) United States Patent
Jonas

(10) Patent No.: US 7,451,825 B2
(45) Date of Patent: Nov. 18, 2008

(54) ANNULAR CHOKE

(75) Inventor: Jason K. Jonas, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 225 days.

(21) Appl. No.: 11/161,939

(22) Filed: Aug. 23, 2005

(65) Prior Publication Data

US 2007/0044956 A1 Mar. 1, 2007

(51) Int. Cl.
*E21B 34/06* (2006.01)

(52) U.S. Cl. ..... 166/373; 166/316; 166/386

(58) Field of Classification Search ..... 166/179, 166/386, 316, 319, 320, 321, 373, 374
See application file for complete search history.

(56) References Cited

U.S. PATENT DOCUMENTS 2,847,074 A * 8/1958 Maly et al. ..... 166/325
3,193,016 A * 7/1965 Knox ..... 166/184
3,326,229 A * 6/1967 Dudley ..... 137/155
3,583,481 A * 6/1971 Vernotzy ..... 166/184
4,576,235 A * 3/1986 Slaughter et al. ..... 166/374
5,156,207 A * 10/1992 Haugen et al. ..... 166/142
6,241,015 B1 6/2001 Pringle
6,631,767 B2 10/2003 Pringle
2001/0045290 A1 11/2001 Pringle

* cited by examiner

*Primary Examiner*—Kenneth Thompson
(74) *Attorney, Agent, or Firm*—Trop, Pruner & Hu, P.C.; Daryl R. Wright; Bryan P. Galloway

(57) ABSTRACT

An apparatus that is usable with a well includes a tubular member, an annular body and plugs. The tubular member includes a wall that defines a passageway to communicate a fluid, and an opening extends through the well. The annular body circumscribes the wall, and the annular body includes orifices that are adapted to communicate the fluid with the opening. The plugs are adapted to be moved to controlled positions relative to the orifices to regulate at least one of a flow rate of the fluid through the opening and a pressure differential across the opening.

16 Claims, 12 Drawing Sheets

ANNULAR CHOKE

BACKGROUND

The invention generally relates to an annular choke, such as an annular choke for a flow control valve, for example.

Flow control valves typically are major components of intelligent well completions to control the flow of well fluids from the reservoir to the tubing string or from the tubing string into the formation. A conventional flow control valve may include a choke, which is a device that may be remotely controlled from the surface to control the flow rate into or out of the tubing string. Typically, the choke restricts flow in a radial direction.

The restriction of flow in the radial direction may be beneficial when controlling well fluid flow in a production application. However, radial flow control may be problematic for controlling the flow during injection or controlling a flow that is in-line with the tubing string. More specifically, for in-line flow, a plug is set inside the tubing string to redirect flow outside of the tubing string; and a large diameter shroud is added to redirect the flow back into the choke. The shroud presents challenges in that the shroud increases the overall envelope of the tool and limits the minimum casing size into which the valve may be installed. For injection applications, the flow ports may be tilted at an angle relative to the axis of the tool rather than being strictly radial. This may reduce, but not eliminate, erosion to the casing. In applications where casing erosion is not acceptable, however, a large diameter shroud is added over the ports to redirect flow into the axial direction.

Thus, there exists a continuing need for a more compact approach to controlling a flow in a well.

SUMMARY

In accordance with an embodiment of the invention, an apparatus that is usable with a well includes a tubular member, an annular body and plugs. The tubular member includes a wall that defines a passageway to communicate a fluid, and an opening extends through the well. The annular body circumscribes the wall, and the annular body includes orifices that are adapted to communicate the fluid with the opening. The plugs are adapted to be moved to controlled positions relative to the orifices to regulate at least one of a flow rate of the fluid through the opening and a pressure differential across the opening.

Advantages and other features of the invention will become apparent from the following description, drawing and claims.

DETAILED DESCRIPTION

Figure 1:
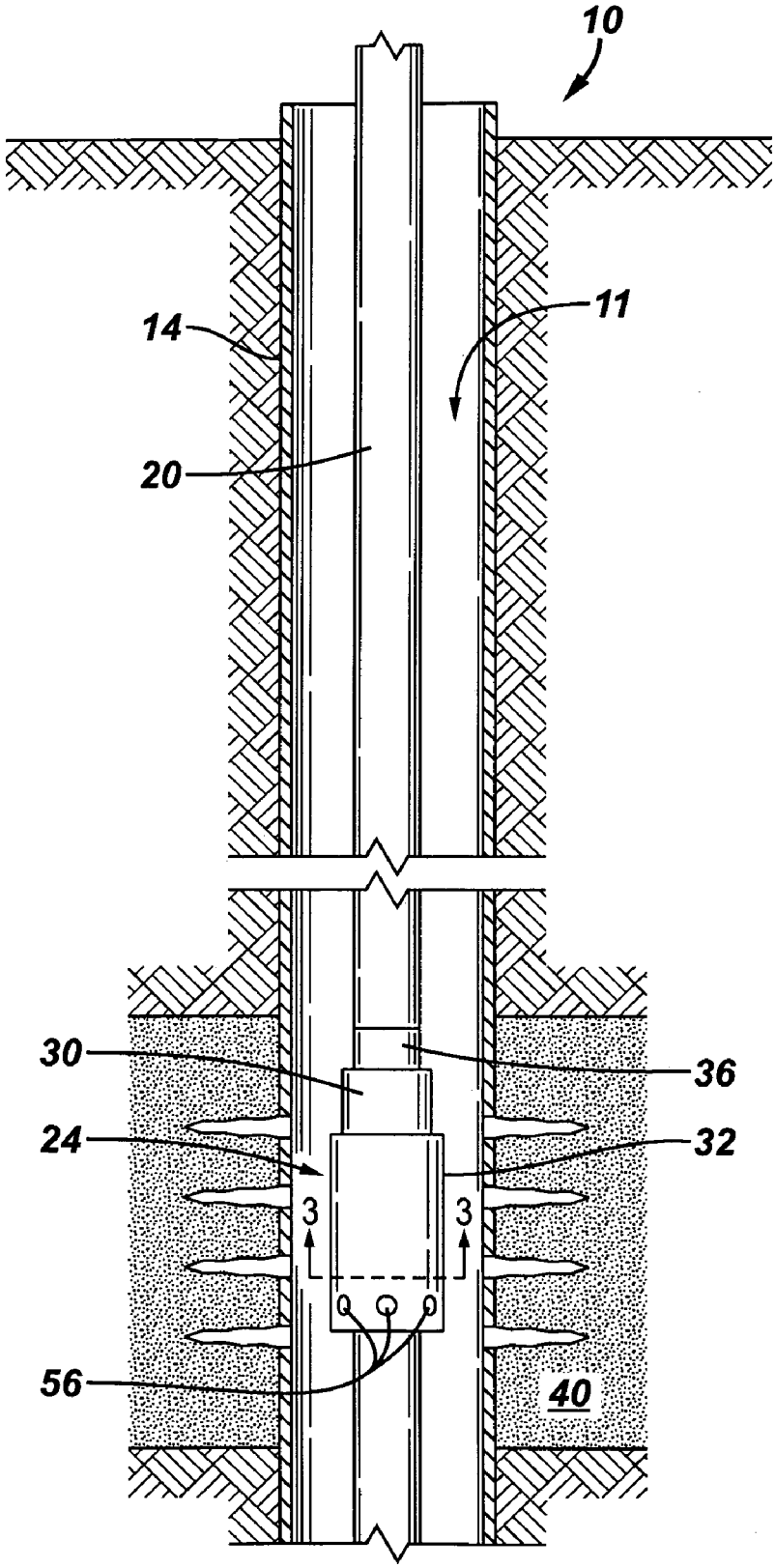
FIG. 1 is a schematic diagram of a well according to an embodiment of the invention.

Referring to FIG. 1, an embodiment of a subterranean well 10 in accordance with the invention includes a wellbore 11 that is lined by a casing string 14. It is noted that the well 10 may be uncased, in other embodiments of the invention. The well 10 includes a tubular production string 20 that extends downhole through the passageway that is defined inside the casing string 14. The production string 20 includes a flow control valve 24 for purposes of regulating flow from a production/injection zone 40 of the well into a central passageway 21 of the production string 20. More specifically, as described further below, the flow control valve 24 includes an annular choke for such purposes as controlling the flow rate of well fluid from the zone 40 into the central passageway of the production string 20 and controlling the differential pressure across the flow control valve 24.

Although a production string 20 is discussed herein, it is understood that the flow control valve 24 may be installed in other tubular strings (such as a string in which fluid is injected from the string into the well, for example) in other embodiments of the invention. Furthermore, although an annular choke is described herein as part of a flow control valve, it is understood that the annular choke may be used apart from the flow control valve 24 in other embodiments of the invention.

The flow control valve 24 includes an annular shroud 32 that (as described below) contains axial flow way orifices that are in communication with ports 56 that extend in generally axial or radial directions through the shroud 32. When the flow control valve 24 is open, well fluid may flow through the ports 56, through one or more flow path orifices of the shroud 32 and into the central passageway of the production string 20.

The flow control valve 24 may be remotely controlled from the surface of the well for purposes of selectively restricting flow through the flow path orifices to control the flow rate at which fluid flows into the production string 20 and control the pressure differential across the valve 24. In this regard, the flow control valve 24 includes a main sleeve 30 that is coaxial with the flow control valve 24 and is connected to plugs (not depicted in FIG. 1) for purposes of selecting restricting the cross-sectional flow areas through the flow path orifices of the flow control valve 24. An actuator 36 of the flow control valve 24 may be remotely controlled from the surface of the well to control the position of the sleeve 30 for purposes of controlling the degree of restriction through the orifices of the flow control valve 24.

The actuator 36 may be one of several different types (electrically- or hydraulically-operated, for example) of actuators, depending on the particular embodiment of the invention. Regardless of the particular form of the actuator 36, in some embodiments of the invention, the actuator receives and possibly decodes one or more stimuli that are communicated from the surface of the well. The actuator 36 responds to the stimuli to regulate the linear position of the sleeve 30 to control the flow rate through the flow control valve 24 and/or pressure differential across the valve 24.

Figure 2:
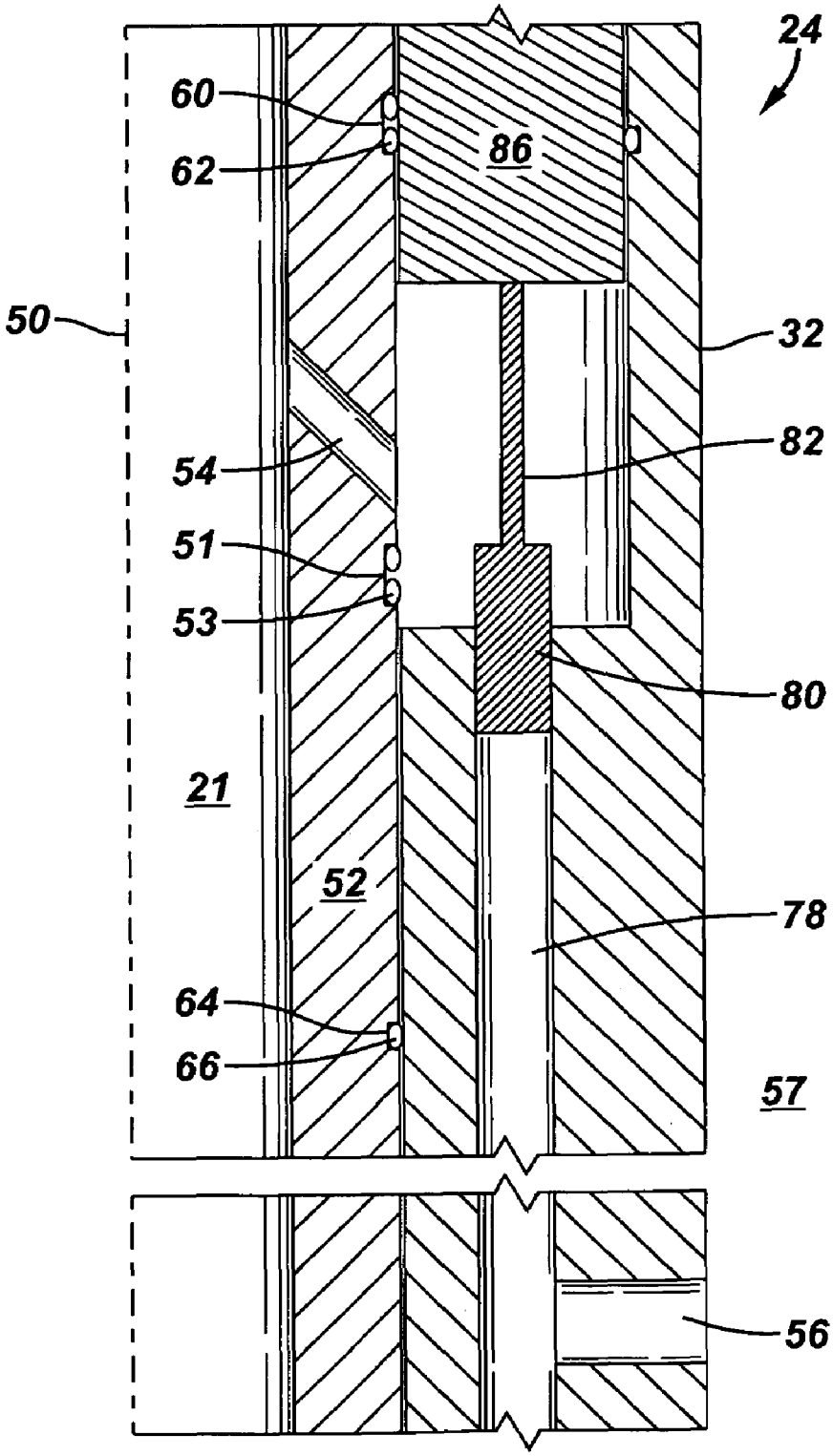
FIG. 2 is a schematic diagram of a flow control valve of FIG. 1 according to an embodiment of the invention.

As a more specific example, FIG. 2 depicts the flow control valve 24 in accordance with some embodiments of the invention. FIG. 2 is a cross-sectional view of the right hand side of the valve. It is understood that the flow control valve 24 is generally symmetrical about a longitudinal axis 50 of the valve 24, and thus, the left hand side of the flow control valve 24 is not shown in FIG. 2. The flow control valve 24 includes a cylindrical valve body 52 that is coaxial with a longitudinal axis 50 of the valve 24. The longitudinal axis 50 is generally aligned with the longitudinal axis of the production string 20 (see FIG. 1) near the flow control valve 24. The valve body 52 includes one or more flow passageways 54 through the body 52. The passageway(s) 54, during an open state of the flow control valve 24, communicate fluid communication with a choke region (described below) of the valve 24.

The flow control valve 24 also includes a sleeve 86 that circumscribes the valve body 52 and is coaxial with the longitudinal axis 50. The upper end of the main sleeve 86 is connected to the actuator 36 (FIG. 2) to permit the actuator 36, through movement of the main sleeve 86, to selectively open and close communication through the passageway(s) 54. In the position that is depicted in FIG. 2, the passageway (s) 54 are open, thereby permitting fluid communication between the choke region of the flow control valve 24 and the central passageway 21 of the production string 20. However, when the sleeve 86 moves in a downward direction to block communication between the central passageway 21 and an annular outer region 57 that surrounds the flow control valve 24, the flow control valve 24 is closed. In this closed state, seals 53 and 62 that are located on the upper and lower sides of the passageway(s) 54, respectively, form a seal between the valve body 52 and the sleeve 86.

The seals 53 and 62 may be unidirectional and/or bidirectional seals, depending on the particular embodiment of the invention. Furthermore, each seal 53, 62 may be formed from V-rings, O-rings or a combination of these rings, as an example. In some embodiments of the invention, the seal 62 generally resides in an annular groove 60 that is formed on the outer surface of the valve body 52; and the seal 53 generally reside in an annular groove 51 that is formed on the outer surface of the valve body 52. It is noted that the seal 53 and/or the seal 62 may reside in an annular groove that is formed in the inner surface of the main sleeve 86, in other embodiments of the invention. As depicted in FIG. 2, the seal 62 contacts the sleeve 86 in both the open and closed states of the valve 24, and the seal 53 contacts the main sleeve 86 during the closed state of the valve 24.

It is assumed for purposes of simplifying the discussion of the choke features of the flow control valve 24 below that the valve 24 is in its open state. In the open state, well fluid communication generally exists between the annular region 57 that surrounds the flow control valve 24 and the central passageway 21 of the string 20. The degree of the fluid communication, i.e., the flow rate through or the pressure drop across the flow control valve 24 in the valve's open state, is controlled by the choke region of the flow control valve 24.

The choke region of the flow control valve 24 is generally formed in an annular region of the valve 24, which surrounds the valve body 52. More specifically, in accordance with some embodiments of the invention, the flow control valve 24 includes axial flow way orifices 78 (one being depicted in FIG. 2) that generally extend along the longitudinal axis 50. For example, in some embodiments of the invention, the flow way orifices 78 are parallel to the longitudinal axis 50. However, in other embodiments of the invention, the flow way orifices 78 may extend along other paths, such as paths that helically, or spirally, extend around the longitudinal axis 50. Thus, many variations are possible and are within the scope of the appended claims.

The flow way orifices 78 are formed inside the outer shroud 32, in some embodiments of the invention. Furthermore, the outer shroud 32 includes the ports 56 that are in communication with the flow way orifices 78. The shroud 32 is sealed to the valve body 52 via a seal 66 that may, for example, be formed from O-rings/V-rings that reside inside an annular groove 64 that is formed on the outer surface of the valve body 52.

For purposes of selectively controlling the flow of fluid through the flow way orifices 78, the flow control valve 24 includes plugs 80 (one being depicted in FIG. 2), each of which is associated with a particular flow way orifice 78. Each plug 80 is coaxially-aligned with the longitudinal axis of the associated flow way orifice 78 so that the plug 80 may be moved away from or into the associated orifice 78 for purposes of controlling flow through the orifice 78. For the position of the plug 80 depicted in FIG. 2, the plug 80 generally blocks flow through the depicted flow way orifice 78. It is noted that movement of the plug 80 into the orifice 78 may completely seal off flow through the orifice 78. Conversely, removal of the plug 80 from the orifice 78 or partial retrieval of the plug 80 in an upward direction increases the flow through the orifice 78 and reduces the pressure drop across the orifice 78.

As depicted in FIG. 2, in some embodiments of the invention, the plugs 80 are connected to the main sleeve 86 of the flow control valve 24. Thus, in accordance with some embodiments of the invention, the plugs 80 move up and down in accordance with movement of the main sleeve 86. More specifically, in some embodiments of the invention, a connecting rod 82 connects each plug 80 to the bottom end of the sleeve 86. Thus, the position of the sleeve 86 may be used to vary the degree of flow through or pressure drop across the flow control valve 24 during the open state of the valve 24.

Figure 3:
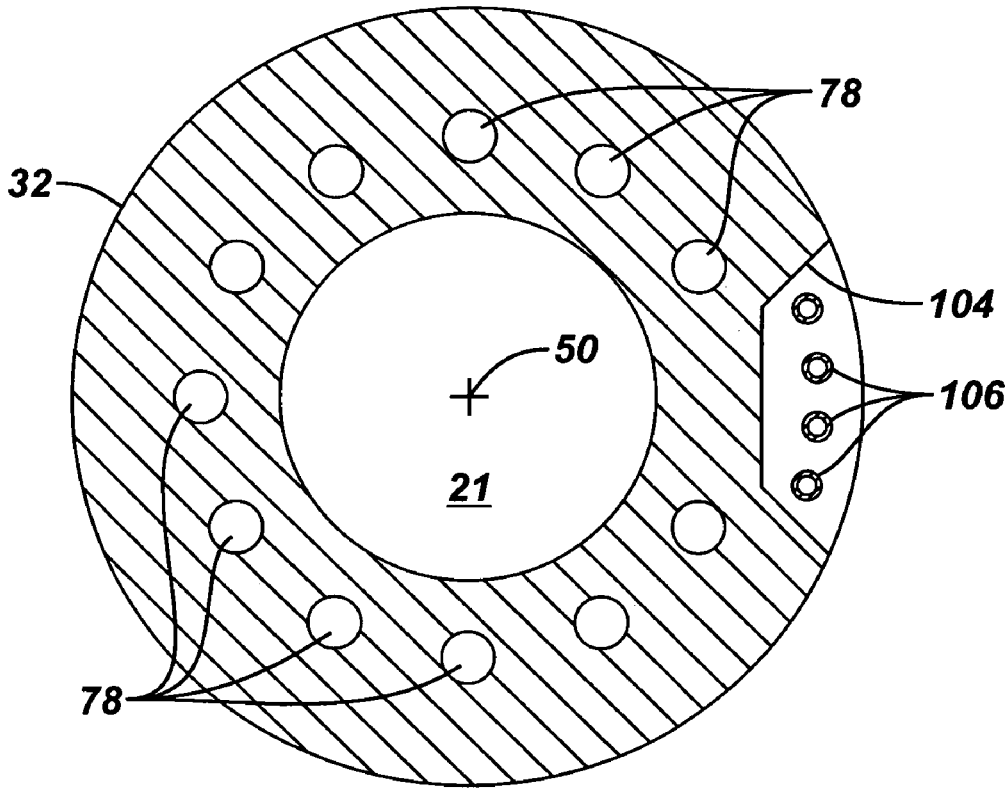
FIG. 3 is a cross-sectional view taken along line 3-3 of FIG. 1 according to an embodiment of the invention.

Referring to FIG. 3, in some embodiments of the invention, the flow way orifices 78 may be, in general, annularly distributed about the longitudinal axis 50. Thus, the flow through the choke region of the flow control valve 24 generally occurs annularly with respect to the central passageway 21 of the valve 24 and axially with respect to the longitudinal axis 50. As also depicted in FIG. 3, in some embodiments of the invention, the outer shroud 32 may include features other than the flow way orifices 78, such as an outer pocket 104 to receive various control lines 106.

Figure 4:
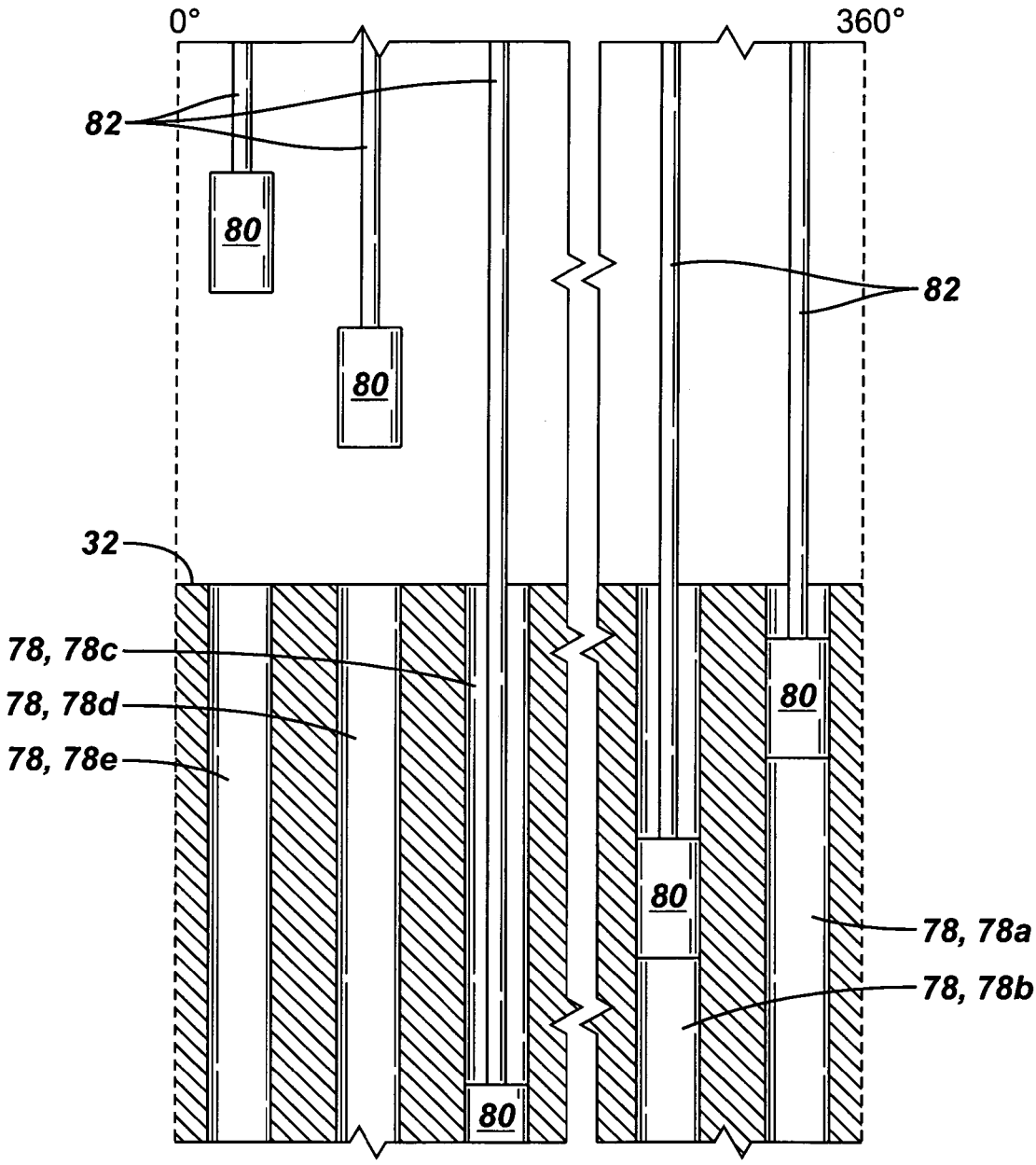
FIG. 4 is a flattened view of the annular shroud and plugs of the flow control valve according to an embodiment of the invention.

Referring to FIG. 4, in accordance with some embodiments of the invention, the connecting rods 82 may have different lengths. Therefore, the plugs 80 are staggered and thus, have different axial positions. This staggered arrangement permits incremental control of the flow through the flow control valve 24. For the position of the sleeve 86 depicted in FIG. 4, plugs 80 extend into the flow way orifices 78*a*, 78*b* and 78*c*. However, plugs 80 do not extend into the flow way orifices 78*d* and 78*e*. Further downward movement of the sleeve 86 may be used to further restrict the sleeve by moving additional plugs into the orifices 78. For example, further movement of the sleeve 86 in a downward direction causes the orifice 78*d* to receive a plug 80 and therefore further restricts the flow. Likewise, further movement of the sleeve 86 in a downward direction causes the orifice 78*e* to receive a plug 80. Conversely, moving the sleeve 86 in an upward direction progressively removes the plugs 80 from the orifice 78 to increase the flow through the flow control valve 24.

Figure 5:
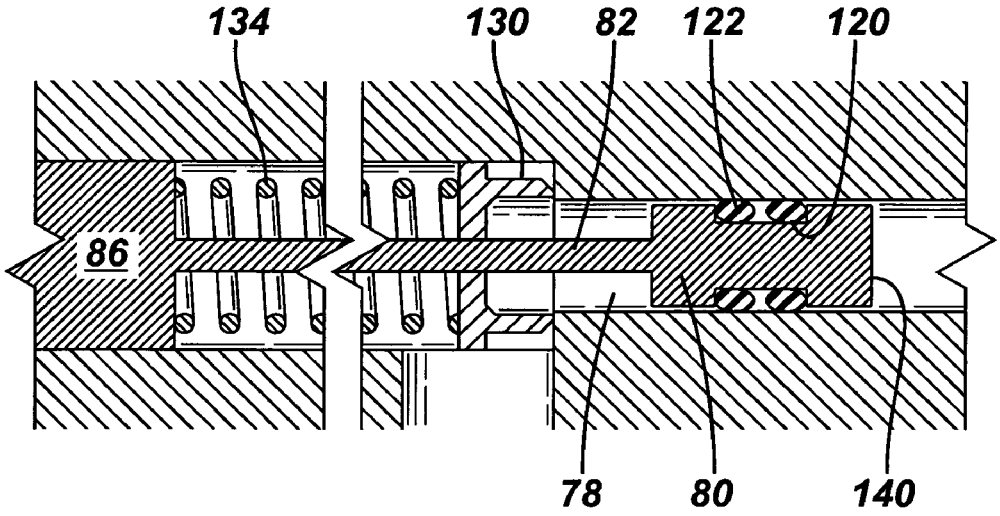
FIGS. 5, 6, 9A and 13 depict assemblies of plug and flow control orifices according to different embodiments of the invention.

Seals may be formed between the plugs and the walls of the receiving orifice 80 in some embodiments of the invention. For example, as depicted in FIG. 5, in some embodiments of the invention, an exterior surface of the plug 80 may include an annular groove 120 that receives a corresponding seal 122 that circumscribes the longitudinal axis of the plug 80. Thus, the seal 122 forms a seal between the outer surface of the plug 80 and the wall of the flow way orifice 78. Similar to the seals 53 and 62 (FIG. 2) described above, the seal 122 may be unidirectional or bidirectional and may be formed from a variety of different sealing rings and combinations.

Seals may be formed to other surfaces of the plug 80 in other embodiments of the invention. For example, in some embodiments of the invention, the seal may be contained in an annular groove that exists in the wall that defines the orifice 78. Thus, a seal may be held by the annular shroud 32 and surround the flow way orifice 78 to form a seal between the orifice wall and the plug 80. As yet another example, in some embodiments of the invention, a seal may be formed between a transverse face 140 of the plug 80 and a corresponding shoulder (not depicted in FIG. 5) of the flow way orifice 78. Thus, the flow way orifice 78 may have a step structure, as further described below, in accordance with some embodiments of the invention. As also depicted in FIG. 5, in some embodiments of the invention, a protective sleeve 130 may generally be circumscribed and connected to the connecting rod 82 for purposes of shielding the seal 122 from damage due to extrusion or erosive flow and a spring 134 from downhole debris. The spring 134, in turn, may be formed between a lower end of the sleeve 86 and the sleeve 130 for purposes of exerting a force on the plug 80 to move the plug into the flow way orifice 80. This force, in turn, may be helpful in cases in which debris is present in the flow way orifice 78.

Figure 6:
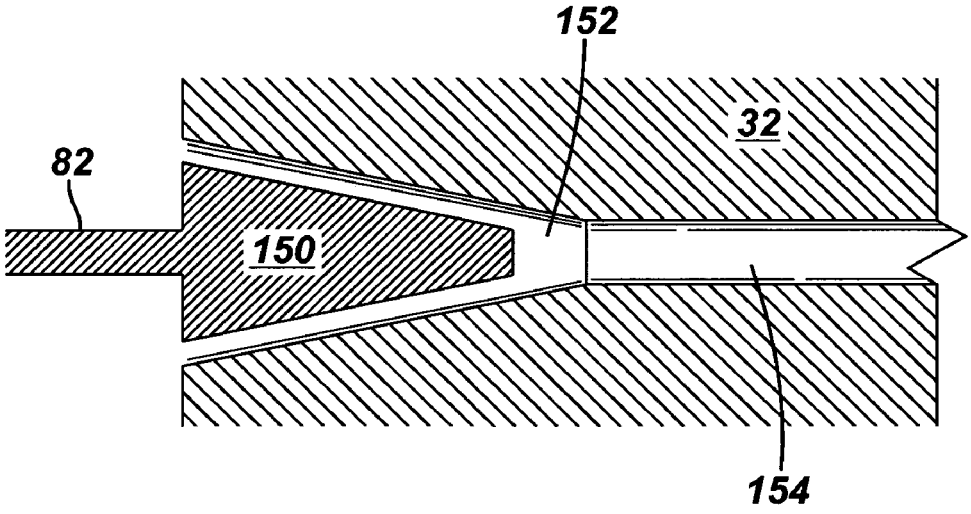

Although the plug 80 may be generally a circular cylinder, in some embodiments of the invention, other shapes may be used for the plug and for the orifice 78. For example, FIG. 6 depicts a tapered plug 150 (replacing the plug 80) that is received inside a tapered orifice opening 152. The tapered orifice opening 152 may lead to a non-tapered passageway 154, in some embodiments of the invention. Furthermore, in some embodiments of the invention, a seal may be formed between the plug 150 and the tapered orifice opening 152.

Figure 7:
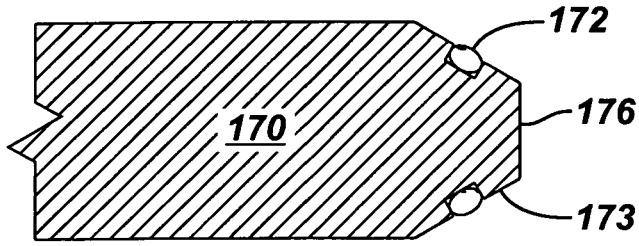
FIGS. 7, 8, 10 and 11 depict plugs according to different embodiments of the invention.

Referring to FIG. 7, as another example of a possible shape for the plug, in accordance with some embodiments of the invention, a plug 170 (replacing the plug described above) may include a tapered or beveled face 173 that extends around the longitudinal axis of the plug 170. The face 173, in turn, may mate with a corresponding inclined face of the orifice, in some embodiments of the invention. Furthermore, the face 173 may include a seal 172 that resides in a groove of the face.

Figure 8:
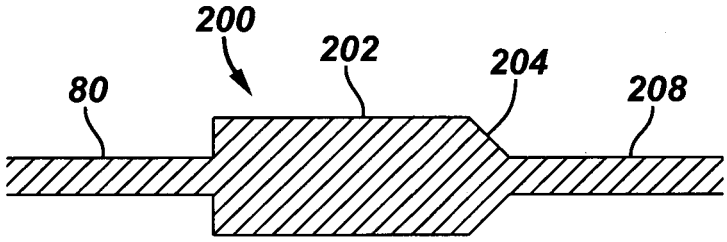

As yet another example of a possible embodiment for the plug, FIG. 8 depicts a plug 200 that includes a generally cylindrical body 202 that has a tapered end 204 that is received inside a tapered orifice opening. The plug 200, in addition to the connecting rod 80 includes a guide rod 208 that further extends into the flow way orifice. In this manner, the guide rod 208 is received in a closely fit opening of the orifice 78 for purposes of guiding the plug into and out of the flow way orifice.

Figure 9A:
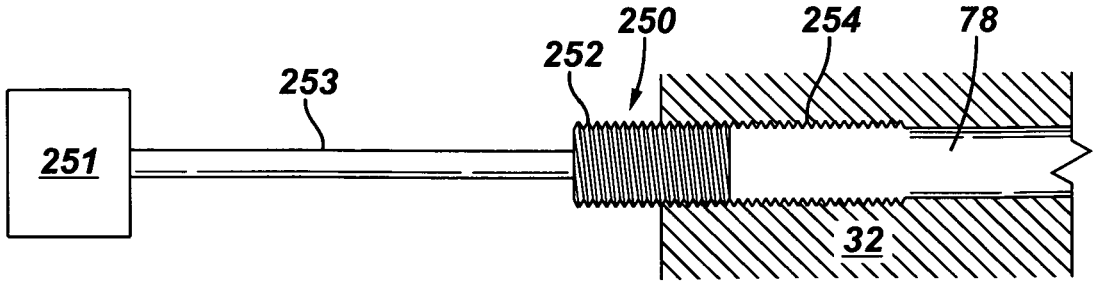

Referring to FIG. 9A, as yet another example of a plug, a plug 250 may include threads 252 that extend in a spiral pattern around the longitudinal axis of the plug 252. These threads 252, in turn, engage corresponding threads 254 that are formed in the inner face of the receiving orifice 78. Thus, the flow control valve 24 may include an actuator 251 that turns a connecting rod 253 that is connected to the plug 252 for purposes of threading the plug 250 into the threaded opening of the orifice 78. The degree of travel inside the orifice opening 78, in turn, regulates the flow through the orifice 78.

Figure 9B:
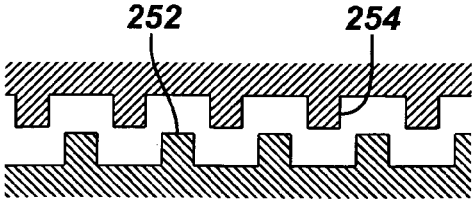
FIGS. 9B, 9C, 9D, 9E, 9F, 9G, 9H, 9I, 9J and 9K depict different teeth profiles of a plug and the wall of a control orifice according to different embodiments of the invention.
Figure 9C:
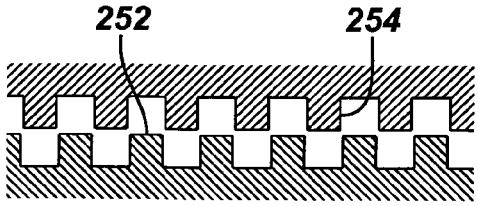
Figure 9D:
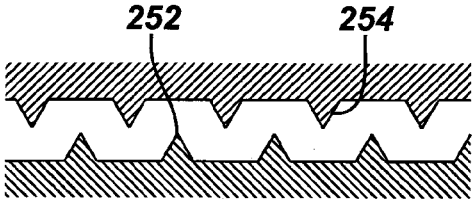
Figure 9E:
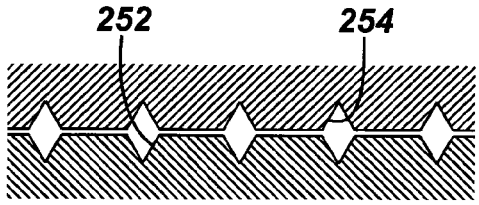
Figure 9F:
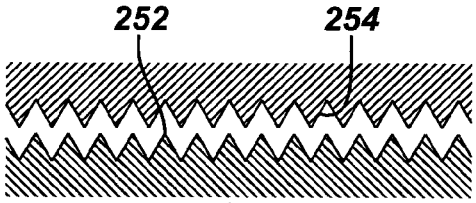
Figure 9G:
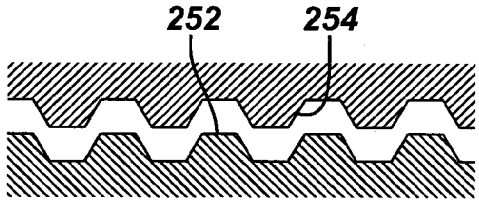
Figure 9H:
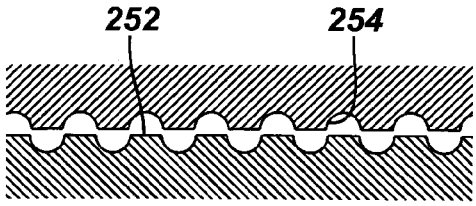
Figure 9I:
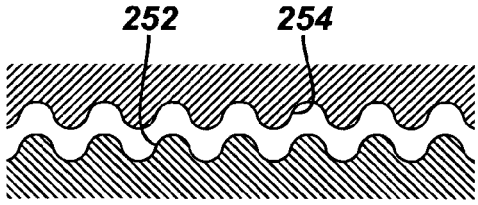
Figure 9J:
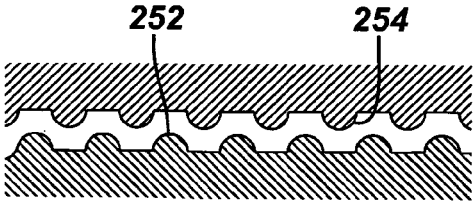
Figure 9K:
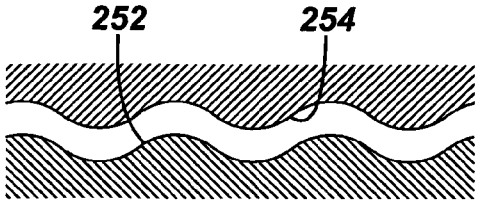

The threads 252 and 254 may have a number of different configurations, depending the particular embodiment of the invention. For example, FIG. 9B depicts the threads 252 and 254 as having rectangular cross-sections; FIG. 9C depicts the threads 252 and 254 as having square cross-sections; FIGS. 9D, 9E and 9F depict different variations in which the threads 252 and 254 have triangular cross-sections; FIG. 9G depicts the threads 252 and 254 as having trapezoidal cross-sections; FIGS. 9H, 9I and 9J depict the threads 252 and 254 as having round cross-sections; and FIG. 9K depicts the threads 252 and 254 as having sinusoidal cross-sections. Many other variations are possible and are within the scope of the appended claims.

Figure 10:
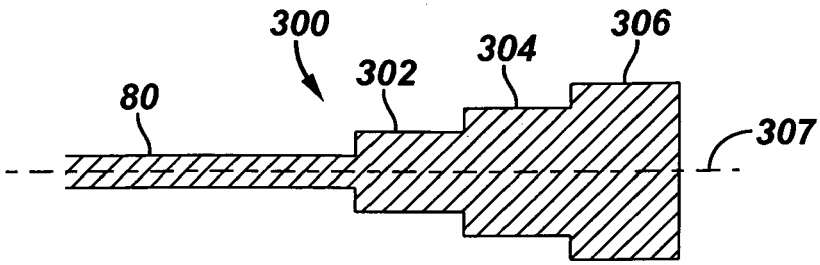

As yet another example of a plug, FIG. 10 depicts a plug 300 that has an annularly-stepped profile. More specifically, in accordance with some embodiments of the invention, the plug 300 includes a first annular region 302 that circumscribes a longitudinal axis of the plug 300. The region 302 transitions into a second annular region 304 that also circumscribes the longitudinal axis of the plug 300 but has a larger outer diameter than the first region 302. The annular region 304 transitions into a larger diameter annular region 306 that also circumscribes the longitudinal axis 307. The annular region 306 is located at the lower end of the plug 300; and the smallest annular region 302 is located at the upper end of the plug 300. Thus, the most incremental flow restriction through the associated flow way orifice 78 occurs when the annular region 306 is first inserted into the orifice opening 78. Insertion of the annular region 304 into the orifice increases the flow restriction with the flow restriction being maximized after the insertion of the smallest annular region 302.

Figure 11:
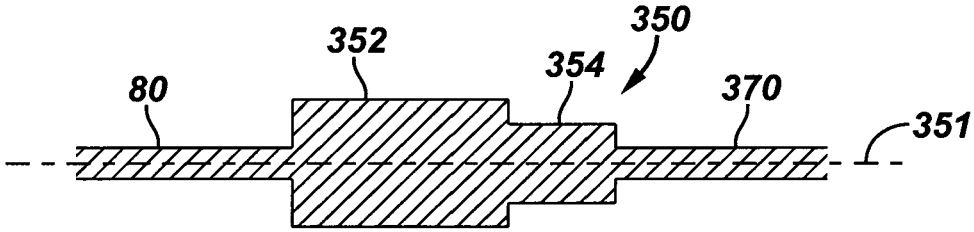

The order of largest to smallest annular stepped regions may be reversed for the plug in some embodiments of the invention. For example, referring to FIG. 11, in accordance with other embodiments of the invention, a plug 350 (having a longitudinal axis 351) includes a relatively small annular region 354 that is located near the bottom end of the plug and a larger outer diameter annular region 352 that is located at the top end of the plug 350. The regions 352 and 354 circumscribe the longitudinal axis 351. As also depicted in FIG. 11, a guide rod 370 may extend from the smaller annular region 354 into the orifice 78.

Figure 12:
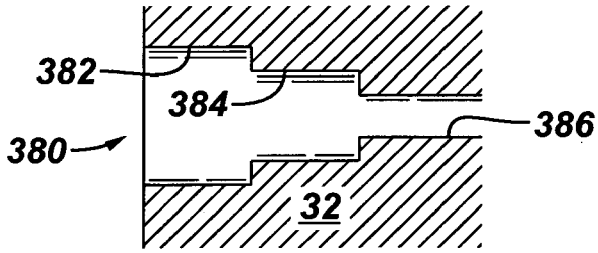
FIG. 12 depicts a flow control orifice according to another embodiment of the invention.

The orifice may have a stepped profile in accordance with some embodiments of the invention. For example, referring to FIG. 12, in accordance with some embodiments of the invention, an orifice 380 includes three stepped annular regions 382, 384 and 386. The region 386 is the smallest region. Moving toward the opening of the orifice 380, the annular 386 transitions to a larger inner diameter annular region 384 that, in turn, transitions to the largest inner diameter region 382.

Figure 13:
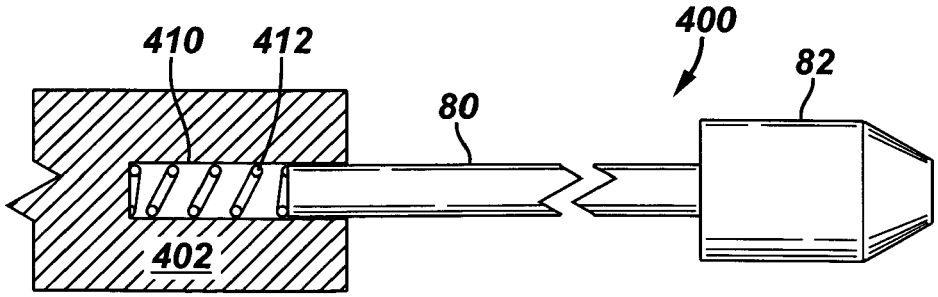

Referring to FIG. 13, in accordance with some embodiments of the invention, an assembly 400 for the choke may include a plug 82 that is connected to a sleeve 402 (replacing the main sleeve 86) via a spring-loaded mechanism. More specifically, in accordance with some embodiments of the invention, the sleeve 402 includes a slot 410 that receives a coil spring 412. The end of the connecting rod 80 is also received into the opening 410 so that the coil spring 412 exerts a force on the connecting rod 80 to force the plug 82 into the flow way orifice. This may be helpful if it is desirable to create a pressure seal between the face of the plug 82 and the orifice (not shown) or for cases in which debris may be located inside the orifice 78.

Figure 14:
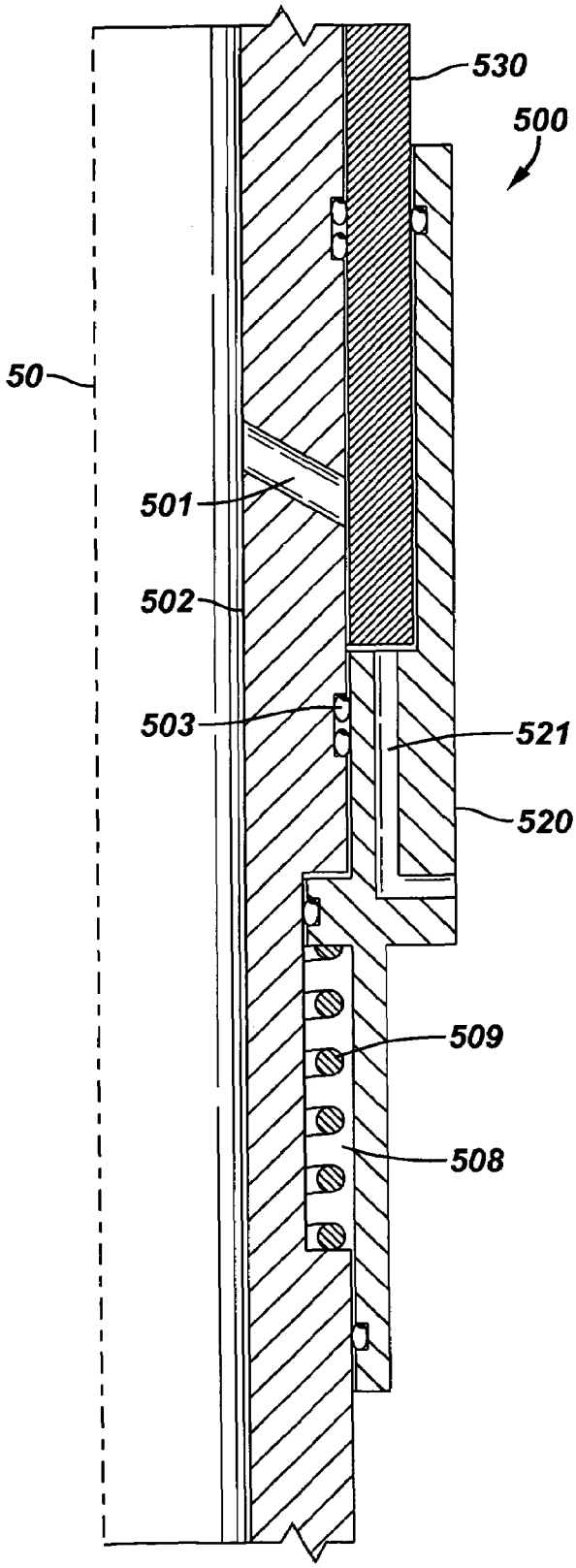
FIGS. 14 and 15 depict flow control valves according to other embodiments of the invention.

Referring to FIG. 14, in accordance with some embodiments of the invention, the above-described flow valves 24 may be replaced by a flow control valve 500 (similar to the depiction of the flow control valve 24 in FIG. 2, only the right side of the flow control valve 500 is depicted in FIG. 14). The flow control valve 500 is similar to the flow control valve 24 in that the flow control valve 500 includes a main valve body 502 that has a port 501 for generally controlling flow through the valve 500. Furthermore, a valve sleeve 530 of the flow control valve 500 circumscribes the valve body 502 for purposes of controlling when the valve 500 is open or closed. When the valve 500 is open, a choke region of the valve 500 may be used to selectively control the rate of fluid flow through the valve 500.

Thus, plugs (not depicted in FIG. 14) may be connected to the bottom end of the sleeve 530 for purposes of insertion into flow way orifices 521 to control flow through the valve 500. Unlike the flow control valve 24, an annular outer shroud 520 (that contains orifices 521) of the flow control valve 500 is spring-loaded with respect to the valve body 502. More specifically, a lower shoulder 529 of the shroud 520 contacts an upper end of a spring 509. The lower end of the spring 509, in turn, contacts an upper shoulder of the valve body 502. Thus, the spring 509 generally resides in an annular pocket 508. Therefore, due to the above-described arrangement, the spring 509 exerts an upward force on the outer shroud 520 so that the shroud 520 serves as a protective sleeve for main seal 503 of the flow control valve 500.

Instead of using the outer shroud 520 as a protective sleeve, in some embodiments of the invention, a flow control valve 600 may be used that contains an additional protective sleeve to protect a main seal 612 of the valve 600. In this manner, the flow control valve 600 includes a port 602 that establishes communication between a central passageway of the valve 600 and a choke region of the valve 600. The passageway 602 is formed in a main valve body 608 of the valve 600. Similar to the other valves described above, an outer shroud 620 of the flow control valve 600 includes various flow way orifices that are selectively restricted by action of a main sleeve 610 of the valve 600. It is noted that the plugs are not depicted in FIG. 15. Unlike, however, the flow control valves that are described above, the flow control valve 600 includes a protective sleeve 614 that generally circumscribes the valve body 608.

Figure 15:
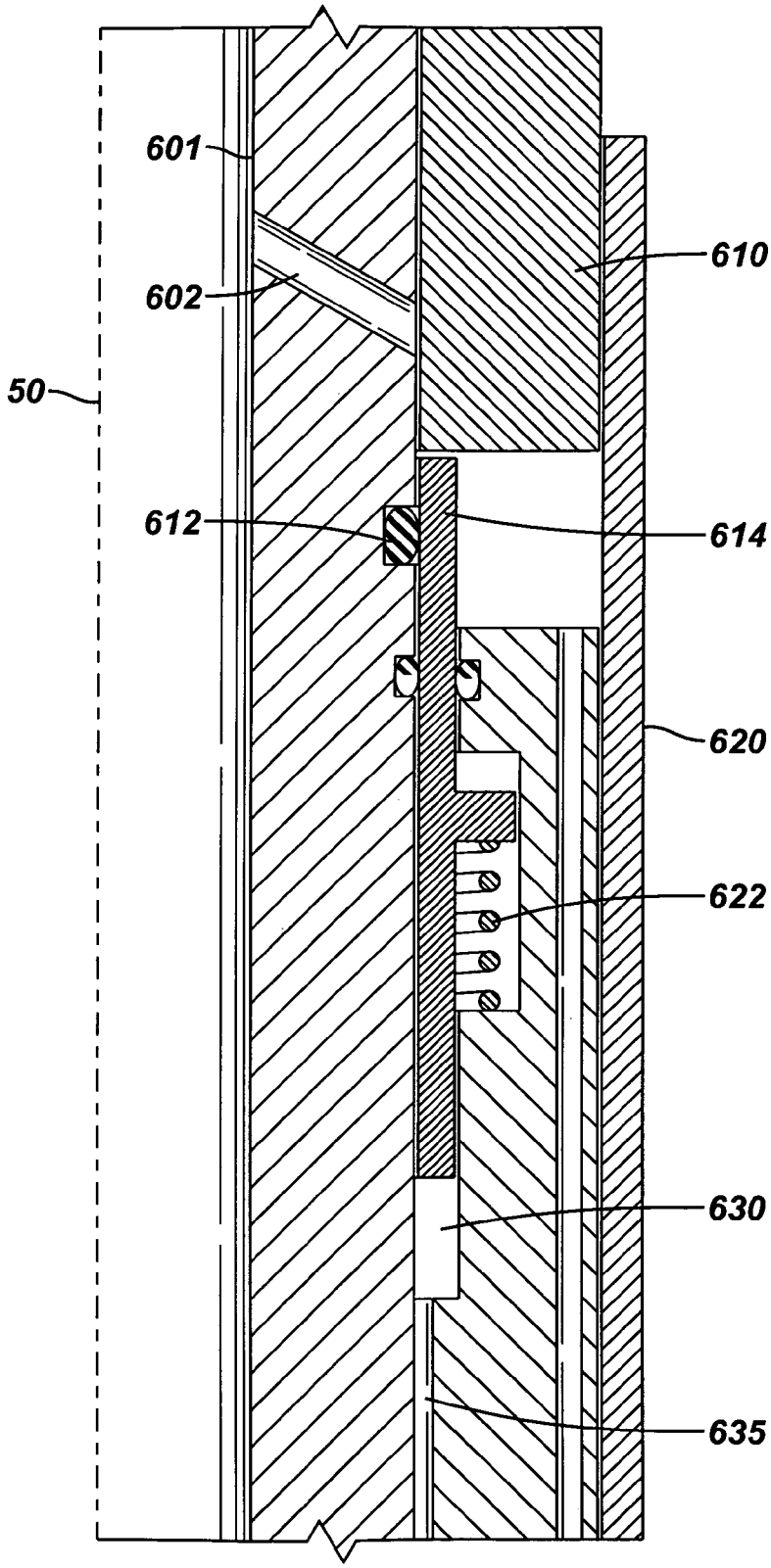

In the state of the valve that is depicted in FIG. 15, the main sleeve 610 has not yet moved to a downward point sufficiently to contact the main seal 612, thereby leaving the valve 600 in an open state. In this state, flow is regulated through the choke mechanism of the valve 600. However, in this state, the protective sleeve 614 is positioned radially on the outside of the seal 612 to protect the seal 612. When the main sleeve 610 moves in a downward direction, the sleeve 610 contacts the protective sleeve 614 to displace the sleeve 614 to move the sleeve 614 in a downward direction and thus, from around the seal 612. It is noted that the sleeve 614 is biased to cover the seal 612 via a spring 622. As depicted in FIG. 15, in some embodiments of the invention, the spring 622 rests on an annular shoulder of the outer shroud 620 in an annular pocket formed between the shroud 620 and the protective sleeve 614. An annular shoulder of the sleeve 614, in turn, contacts the upper end of the spring 622 to allow the spring 622 to exert the upward bias on the sleeve 614.

Among the other features of the flow control valve 600, in some embodiments of the invention, the sleeve 614 generally resides in an annular region 630 that is formed between the outer shroud 620 and the outer surface of the main valve body 601. For purposes of equalizing pressure, a flow passageway 635 may be formed between the annular region 630 and the region that surrounds the flow control valve 600.

Figure 16:
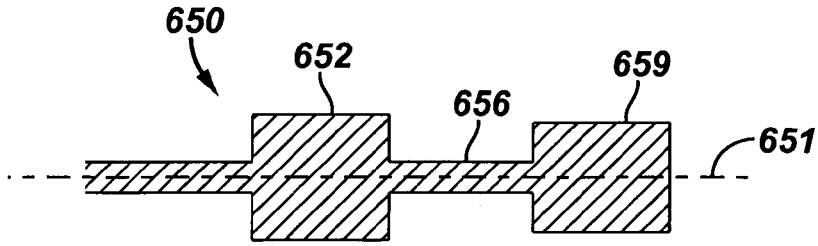
FIG. 16 depicts a plug assembly according to an embodiment of the invention.

As yet another example of another embodiment of the invention, FIG. 16 depicts a plug assembly 650 that includes multiple plugs. In this manner, in accordance with some embodiments of the invention, the plug assembly 650 includes an upward plug 652 and a lower plug 659. The upper 652 and lower 659 plugs are connected together by a connecting rod 656. An upper connecting rod 651 connects the upper plug 652 to the valve sleeve (not shown in FIG. 16). The upper plug 652, the lower plug 659, upper connecting rods 651 and lower connecting rod 656 are all concentric with respect to a longitudinal axis 651 of the plug assembly 650. Thus, many variations are possible and are within the scope of the appended claims.

Figure 17:
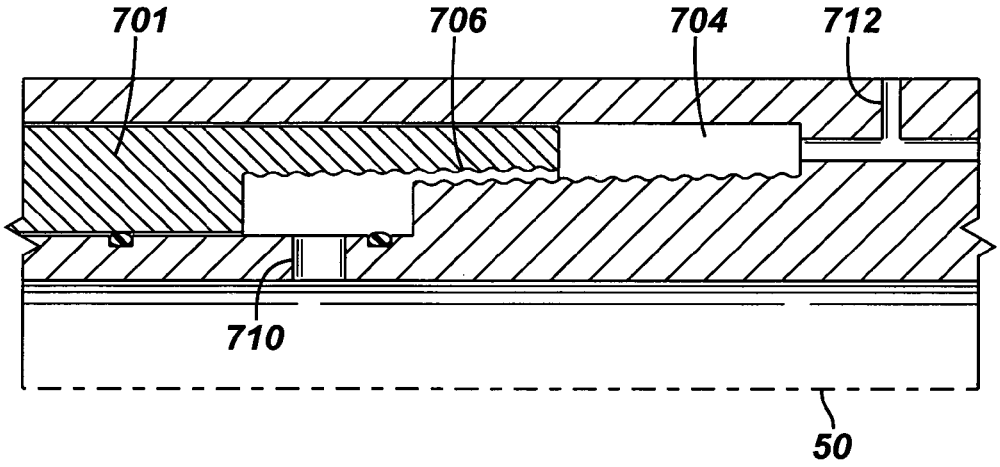
FIGS. 17, 20 and 21 depict circumferential plug and orifice assemblies according to other embodiments of the invention.

In accordance with other embodiments of the invention, instead of using plugs and multiple orifices to control flow, another arrangement in accordance with an embodiment of the invention includes a using a circumferential plug to progressively block flow through a corresponding circumferential orifice. As a more specific example, FIG. 17 depicts a circumferential plug 701 that may be moved up and down relative to the longitudinal axis 50 for purposes of progressively blocking flow through a circumferential orifice 704. Thus, when removed from the orifice 704, generally unrestricted flow is allowed to occur between a port 710 and a radial port 712. As the plug 701 moves into the orifice 704, the flow is progressively blocked.

Figure 18:
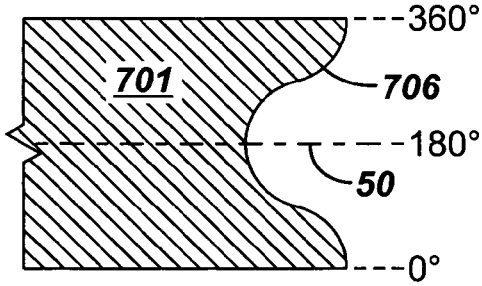
FIGS. 18 and 19 depict different circumferential profiles for the plug and orifice walls of the assembly of FIG. 17 according to different embodiments of the invention.

As yet another example of an additional embodiment of the invention, the end profile of the plug may vary for purposes of progressively blocking flow through a particular orifice. FIG. 18 depicts an exemplary plug 701 that has an end profile 76 that varies in a sinusoidal fashion about the longitudinal axis 50. Thus, FIG. 18 depicts the plug 701 as being cut along the longitudinal axis 50 and unrolled. As shown, the end profile 706 follows a sinusoidal pattern.

Figure 19:
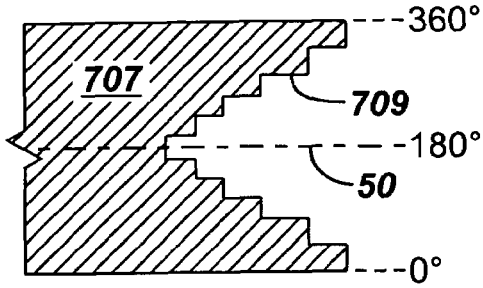

As yet another example, FIG. 19 depicts an exemplary plug 707 that has an end profile 709 that varies about the longitudinal axis 50 in a stepped fashion. Thus, many variations are possible and are within the scope of the appended claims.

Figure 20:
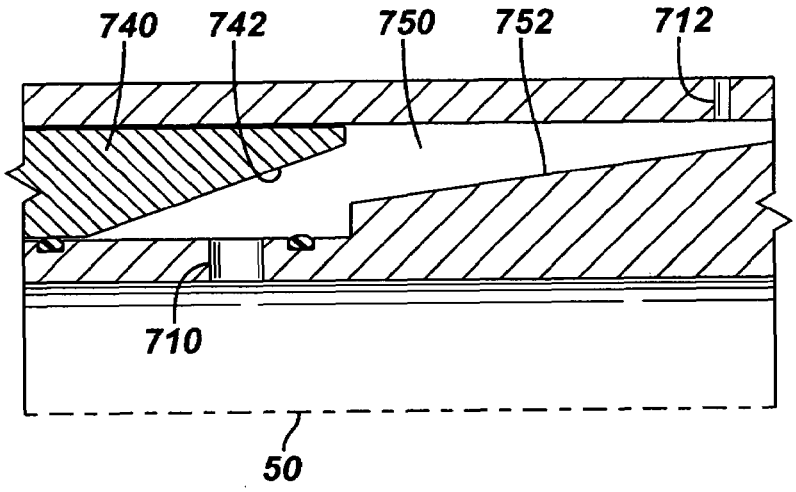

FIG. 20 depicts a plug 740 that may be used to progressively block flow through a circumferential orifice 750 according to another embodiment of the invention. As shown, the plug 740 has a conical inner profile 742 that circumscribes the longitudinal axis 50 and generally corresponds to an inner wall profile 752 of the orifice 750.

Figure 21:
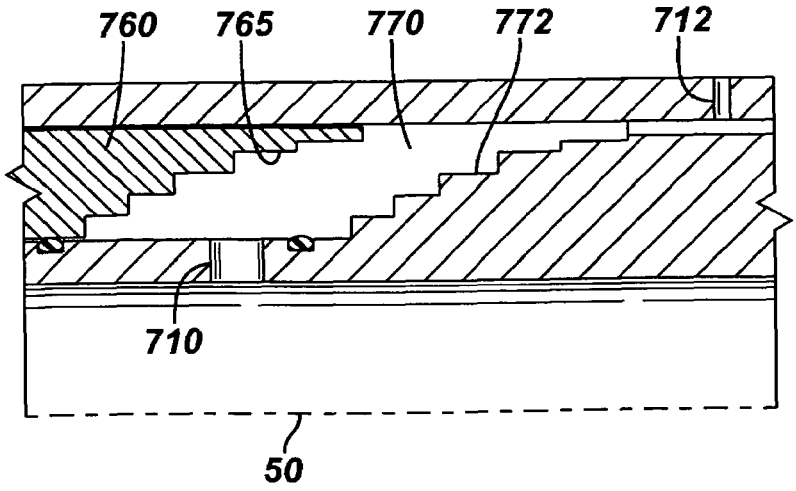

As yet another example, FIG. 21 depicts a plug 760 that has a stepped longitudinal profile 765 to progressively block flow through an orifice 770. An inner wall 772 that defines the orifice 770 may also be longitudinally-stepped according to an embodiment of the invention. Thus, many embodiments and variations are possible and are within the scope of the appended claims.

Although orientational and directional terms such as "upper," "lower," "up," and "down" have been used herein to simplify the preceding description, it is understood that the embodiments of the invention are not limited to the described orientations and directions. For example, in some embodiments of the invention, the flow control valve 24 may be deployed in a lateral wellbore in which the main sleeve (and other components) generally move from side-to-side instead of up and down.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An apparatus usable with a well, comprising:

a tubular member defining a passageway to communicate a fluid, an opening extending through a wall of the tubular member;

an annular body to circumscribe the passageway, the annular body comprising orifices adapted to communicate the fluid with the opening;

plugs disposed at different circumferential positions about the passageway and adapted to be moved to controlled positions relative to the orifices to establish at least one of a flow rate of the fluid through the opening and a pressure differential across the opening; and wherein longitudinal axes of the orifices are generally parallel to a longitudinal axis of the passageway.

2. The apparatus of claim 1, wherein the plugs are staggered at different axial positions.

3. The apparatus of claim 1, wherein at least one of the orifices is associated with a plug and the plug is adapted to progressively close the associated orifice as the plug moves into the associated orifice.

4. The apparatus of claim 1, further comprising:

a sleeve, wherein the plugs are attached to the sleeve to move in unison with sleeve.

5. The apparatus of claim 4, further comprising:

a seal formed between sleeve and annular body.

6. The apparatus of claim 5, further comprising:

seal formed between annular body and the wall of the tubular member.

7. The apparatus of claim 4, further comprising:

rods to connect the plugs to the sleeve.

8. The apparatus of claim 1, wherein plugs have different positions relative to each other along a longitudinal axis of the annular body.

9. The apparatus of claim 1, wherein at least one of the plugs comprises regions of constant outer diameter, the outer diameters being different from all of the other outer diameters.

10. The apparatus of claim 1, wherein the plugs are adapted to move along paths that are each substantially parallel to a longitudinal axis of the passageway.

11. A method usable with a well, comprising:

routing well fluid through separately controllable orifices that are located in an annular region that surrounds a central passageway of a tubing of the well; and selectively restricting fluid communication through the orifices to establish different flow rates through the orifices, comprising positioning plugs at different axial positions relative to each other to selectively restrict fluid communications through the orifices.

12. The method of claim 11, further comprising:

controlling the communication through the orifices in response to a position of a main sleeve of a flow control valve.

13. A method usable with a well, comprising:

routing a well fluid through an orifice that is located in an annular region that surrounds a central passageway of a tubing of the well;

selectively restricting fluid communication through flow paths that are each elongated along the central passageway and disposed in the annular region to regulate at least one of a flow rate and a pressure differential and controlling the restriction in response to a position of a main sleeve of a flow control valve.

14. The method of claim 13, wherein the act of selectively restricting comprises:

moving a plug relative to a wall of the orifice.

15. The method of claim 13, wherein each of the flow paths is substantially parallel to a longitudinal axis of the passageway.

16. The method of claim 13, wherein each of the flow paths substantially extends helically about a longitudinal axis of the passageway.

* * * * *